United States Patent [19]

Groke

[11] 4,403,651

[45] Sep. 13, 1983

[54] HEATPIPE WITH RESIDUAL GAS COLLECTOR VESSEL

[75] Inventor: Ulrich Groke, Duren, Fed. Rep. of Germany

[73] Assignee: Julich Gesellschaft mit beschrankter Haftung, Julich, Fed. Rep. of Germany

[21] Appl. No.: 298,353

[22] Filed: Sep. 2, 1981

[30] Foreign Application Priority Data

Sep. 11, 1980 [DE] Fed. Rep. of Germany ..... 3034192

[51] Int. Cl.[3] ..... F28D 15/00

[52] U.S. Cl. ..... 165/104.27; 165/DIG. 24; 165/104.21

[58] Field of Search ..... 165/104.27, 104.33, 165/32, DIG. 24, 104.21

[56] References Cited

U.S. PATENT DOCUMENTS 3,563,309 2/1971 Basiulis ..... 165/32 X

FOREIGN PATENT DOCUMENTS 649937 2/1979 U.S.S.R. ..... 165/32

OTHER PUBLICATIONS

W. Bienert *Heat Pipes For Temperature Control,* Proceedings of the Fourth Intersociety Energy Conversion Engineering Conference, Wash., DC, 9/22-26/1969, pp. 1033-1041.

Kirkpatrick et al., JP *A Variable Conductance Heat Pipe Flight Experiment,* AIAA 6th Thermophysics Conf. Tullahoma, Tenn., 4/26-28/1971, AIAA Paper No. 71-411, AIAA, NY, NY.

*Primary Examiner*—Albert W. Davis, Jr.

*Attorney, Agent, or Firm*—Scully, Scott, Murphy and Presser

[57] ABSTRACT

A heatpipe with a hermetically-sealed residual gas collector vessel which stands in communication with the upper end of the heatpipe. The heatpipe is characterized in that the collector vessel is arranged within the heatpipe adjacent to the vaporization end thereof in such a manner that the fluid which is to be vaporized reaches the vaporization end without hindrance, and wherein the collector vessel stands in communication with the condensation end through an open-ended narrow gas conducting tube which terminates there, and whose other end leads to the condensate collecting point in the collector vessel.

13 Claims, 1 Drawing Figure

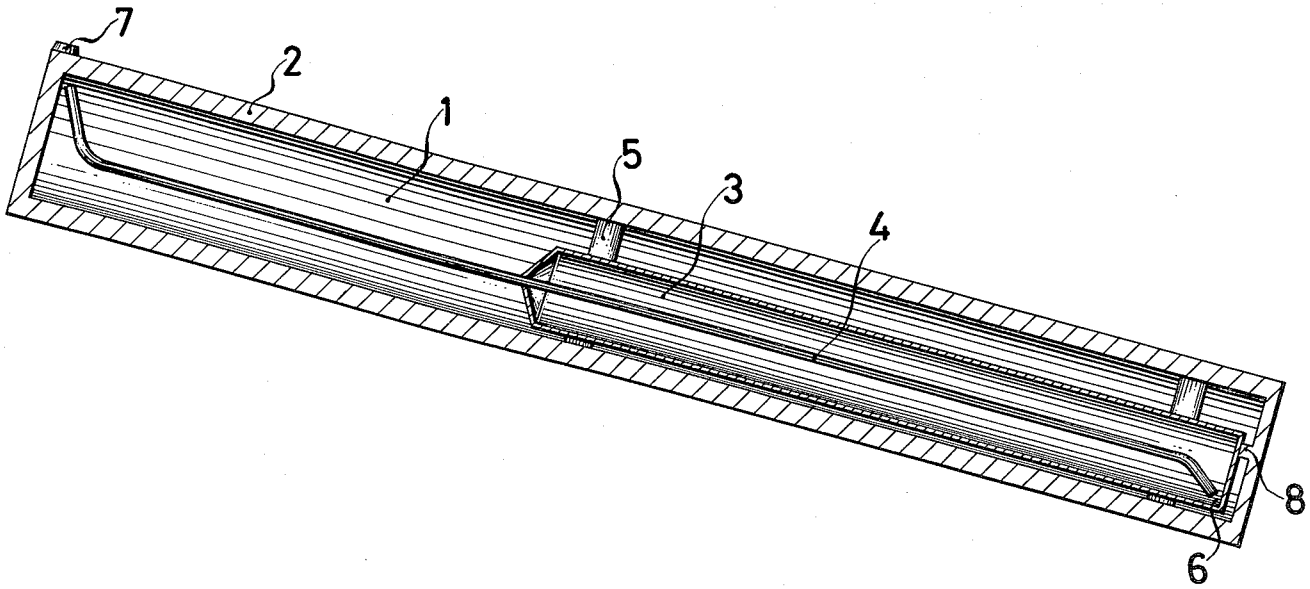
7
2
1
5
3
4
6
8

HEATPIPE WITH RESIDUAL GAS COLLECTOR VESSEL

BACKGROUND OF THE INVENTION

1. Field of the Invention

The present invention relates to a heatpipe with a hermetically-sealed residual gas collector vessel which stands in communication with the condensation end or upper end of the heatpipe.

Designated as a heat pipe is primarily a connecting element which extends in a direction of heat conductance, in which the heat of vaporization of a fluid is utilized for the heat conductance, which is vaporized at the hot end and again condensed at the colder end. Usually this heatpipe is formed by a hermetically-sealed tilted tube which contains a small quantity of a low boiling fluid. The lower region of the tube is brought into contact with a region of excess heat (for example, a solar collector) and there heated. Hereby, the fluid contained therein is vaporized and the vapor will rise into the upper region of the tube, from which heat is withdrawn whereby the fluid condenses and, due to gravity, will then again return to the lower region of the tube. Such an at least between slightly inclined up to vertical arrangement of the tube is not required when the reconveyance of the condensed fluid can be effectuated through capillary forces (through the intermediary of a correspondingly shaped inner wall).

2. Discussion of the Prior Art

Since an absolutely sealed receptacle does not exist, and the heatpipe in the cold condition thereof evidences a vacuum with respet to ambience, during the course of time a gas cushion will form within the heatpipe, which increasingly hinders the heat conductance or even bring it to a standstill. In order to reduce the disruptive influence of the collecting gas, in German Published Patent Application No. 21 37 227 there has already been proposed an additional residual gas collector vessel which stands in communication with the upper end of the heatpipe, which is arranged above the upper end of the heatpipe and which is provided with a good thermal insulation. By means of such a collector vessel, the residual gas component in the heatpipe can reduce itself and its function can thus be extended. However, it is disadvantageous that such a collector vessel produces a heat loss and, moreover, it can be spatially hindersome so that, further, the occasionally relatively high pressures which are encountered during heatpipe operation must also be withstood by this collector vessel.

SUMMARY OF THE INVENTION

Accordingly, it is an object of the present invention to provide a heatpipe in which the problems which are interrelated with residual gas collection are extensively ameliorated.

The inventive heatpipe of the above-mentioned type which has been developed for this purpose is thus characterized in that the collector vessel is arranged within the heatpipe adjacent to the vaporization end thereof in such a manner that the fluid which is to be vaporized reaches the vaporization end without hindrance, and wherein the collector vessel stands in communication with the condensation end through an open-ended narrow gas conducting tube which terminates there, and whose other end leads to the condensate collecting point in the collector vessel. At the condensate collecting point condensate would collect during shutdown.

The specialized shape of the heatpipe hereby plays no role, and it can basically have a configuration deviating from the tubular form, or can be formed by a coiled or curved tube. Most widespread in use, however, is the extended tube form with ends which are closed, of which the one heat receiving end can be designated as the vaporization end and the heat emitting end as the condensation end. Suitably, such a heatpipe is utilized in an at least slightly inclined position, in which the condensate formed at the condensation end will return to the vaporization end under the effect of gravity.

For such a heatpipe, the collector vessel is preferably formed through a hermetically sealed tube which is inserted into the heatpipe with a spacing relative to the vaporization end, with a welded or soldered in, or otherwise sealed, inserted narrow gas conducting tube, which leads from the uppermost point of the heatpipe at the condensation end to the lowermost point of the collector vessel.

The mode of operation of the inventive heatpipe can be most simply explained with respect to this preferred embodiment, so that the following description is based on this embodiment.

In this arrangement, the disruptive residual gas which has been driven to the upper end by a kind of pumping effect by the fluid vapor, is conducted to the lowermost location of the collector vessel through the intermediary of the narrow gas conducting tube, from which it then moves to the highest location thereof. Thus, within the collector vessel there is primarily taken up the residual gas, whose portion thereby increases relative to the "main container" of the heatpipe and is reduced in the last-mentioned, so that the function of the heatpipe is overall improved.

The vapor which is conducted into the collector vessel can condense out during the operating pauses and will then be the first to be again pressed into the "main container" of the heatpipe through the narrow tube leading to the lowermost point in the collector vessel. During operation, in time there will be produced in the collector vessel a similar unmixing effect as in the main tube, which serves for the localizing of the residual gas in the upper region of the collector vessel whereby there is hindered a residual gas reconveyance into the main tube.

The size of the collector vessel directs itself pursuant to the "gas accumulation" within the heatpipe, and usually lies at about 10 to 40% of the volume, particularly at 20 to 25%. Furthermore, the collector vessel is so arranged as not to be located within the heat-emitting portion of the heatpipe, and its shape is so correlated with the shape of the heatpipe that the vapor can unhinderedly flow back to the location which is to be heated and the condensate can flow back to the vaporization end. For a tubularly-shaped heatpipe, the collector vessel is, in particular, formed by an inserted tube.

The collector vessel can be constituted of a similar material and have a wall of a nature similar to that of the heatpipe itself and, naturally, must be able to withstand the internal temperatures which can occur in the heatpipe. It must be sealed against diffusion and stand the communication with the heatpipe inner space only through the narrow tube. However, any special strength thereof is not required since the collector vessel is not subjected to any kind of pressure and thus can be produced of very thin material.

The narrow tube which leads from the upper end of the heatpipe to the lowermost point of the collector vessel should, in all instances, be dimensioned so large that it cannot fuse closed. It should provide for the unhindered transfer of the collecting gas into the collector vessel, however, if at all possible no turbulences should arise within the tube which would effect an intensified admixing of vapor components.

The inner diameter of the narrow tube should hereby preferably not exceed 5 mm, and usually tube diameters are selected with dimensions of 1 to 5 mm.

The inner diameter of the collector vessel should, for current heatpipe sizes, lie in the range of about 3 to 10 centimeters, depending upon the inner diameter of the heatpipe itself. Preferably, the inner diameter of the collector vessel should at most approximately equal 0.7 the inner diameter of the heatpipe. The length of the residual gas collector vessel directs itself in conformance with the residual gas which is to be collected and can consist of 80–90% of the overall length of the heatpipe. Measured as the distance of the collector vessel from the vaporization end of the heatpipe are dimensions of about 1 to 10 mm.

The collector vessel can be rigidly mounted in the heatpipe during manufacture which, however, is not absolutely necessary.

Provision must merely be made for that the position of the narrow tube corresponds to the desired function; in essence, that the lower end terminates at the lowermost point in the collector vessel and the upper end in the upper end of the heatpipe. This can be achieved through respective latching arrangements, such as, for example, a groove and spring at the inner bottom of the heatpipe interior chamber, or by means of an insert spring on the collector vessel, or also through corresponding one sided spacer retainers, which automatically serve for the desired positioning of the collector vessel.

Through external markings, for a rigidly mounted or latched-in collector vessel, attention can be brought to the position of the heatpipe presently to be maintained, which corresponds to the operationally correct arrangement of the narrow tube and collector vessel. Through slide supports and measured point of weight distribution, there can also be provided for a current automatic correcting positioning of the inventively provided built-in units.

BRIEF DESCRIPTION OF THE DRAWING

The invention is described in detail hereinbelow on the basis of an exemplary embodiment, taken in conjunction with the single FIGURE in the accompanying drawings which illustrates a longitudinal section through the inventive heatpipe.

DETAILED DESCRIPTION

In this embodiment, a collector vessel 3 is provided in the inner chamber 1 of the heatpipe 2, and which stands in communication with the heatpipe inner chamber through a narrow tube 4. Spacer retainers 5 which are provided along a shell line serve that the shell line of the collector receptacle 3 facing towards the outlet end 6 of the narrow tube 4 lies against the heatpipe inner surface. A marking, such as at 7, on the outside surface of the heatpipe will then provide information with respect to the functionally-correct operational position of the heatpipe.

A spacer retainer 8 at the bottom side serves to provide an adequate free space on the "bottom" of the heatpipe, so as not to hinder the vaporization function thereof.

An inventive heatpipe of the presently described type was constructed from steel, wherein the "main tube" had a length of 3 meters, an inner diameter of 40 mm, and a wall thickness of 3 mm. The inserted collector vessel was 2.6 meters long and had an inner diameter of 25 mm and a wall thickness of 2 mm. Serving as the narrow tube was a capillary having a 3 mm diameter and a 0.5 mm wall thickness, which was welded into the collector vessel, and which lead to the uppermost point of the heatpipe operated at an incline of about 10° with regard to the horizontal. The heatpipe was maintained at 175° C. at the vaporization end and the condensation end exposed to ambience. The temperature measured at the condensation end, after an introducing phase, practically reached the value of 175° C., which could not be completely achieved with the same heatpipe without the inventive insert. From the foregoing there can be ascertained the improved heat transfer through intermediary of the inventive arrangement.

Water served as the fluid. The walls spacing consisted of about 10 mm.

What is claimed is:

1. A heatpipe, said heatpipe including a hermetically sealed residual gas collector vessel communicating with the condensation end of the heatpipe, said collector vessel being arranged within the heatpipe adjacent the vaporization end thereof, so that the fluid to be vaporized unhinderedly reaches the vaporization end, and an open-ended narrow gas conducting tube having a maximum inner diameter of 5 mm, said collector vessel being in communication with the condensation end through said narrow tube ending at said end, the other end of said narrow tube leading to the condensate collecting point in the collector vessel.

2. A heatpipe as claimed in claim 1, said collector vessel having an inner diameter not exceeding about 0.7 the inner diameter of said heatpipe.

3. A heatpipe having a gas collector for collecting residual gases, said heatpipe comprising:

(a) an elongated and hermetically sealed heatpipe, said heatpipe having a vaporization end and a condensation end;

(b) a sealed residual gas collection vessel mounted in said heatpipe adjacent the vaporization end, said vessel having a condensate collecting point and a residual gas collecting region;

(c) a working fluid for vaporization and condensation;

(d) a small diameter gas conducting tube, said conducting tube extending from the condensate end of said heatpipe to the condensate collecting point in said residual gas collector;

whereby non-working residual gases are conveyed from the condensate end of said heatpipe to the interior of said sealed gas collection vessel.

4. A heatpipe as claimed in claim 3 wherein:

(a) said heatpipe comprises a straight tube hermetically closed at both ends thereof;

(b) said gas collection vessel being tubular in form and positioned a predetermined distance from an inner wall of said heatpipe at the vaporization end thereof.

5. A heatpipe as claimed in claim 4 wherein the heatpipe is vertically inclined at least 10° with the small diameter gas conducting tube extending from the lower most point in the residual gas collection vessel, to the uppermost point of said heatpipe.

6. A heatpipe as claimed in claim 3 wherein said small diameter gas conducting tube has a maximum inner diameter of 5 mm.

7. A heatpipe as claimed in claim 4 wherein the inner diameter of the tubular gas collection vessel does not exceed 70% of the inner diameter of the heatpipe.

8. A heatpipe as claimed in claim 4 wherein the length of the sealed gas collection vessel is 80–90% of the length of the heatpipe.

9. A heatpipe as claimed in claim 3 wherein said sealed collection vessel is spaced from the inner wall of said heatpipe at the vaporization end thereof by a distance of 1–10 mm.

10. A heatpipe as claimed in claim 8 wherein the volume of the sealed gas collection vessel is 10–40% of the volume of the heatpipe.

11. A heatpipe as claimed in claim 3 wherein an inner wall of the heatpipe and an inner wall of the sealed collector vessel comprises capilary walls.

12. A heatpipe as claimed in claim 3 wherein said heatpipe is inclined at least 10° to allow said working fluid to flow from the upper condensate end to the lower vaporization end along an inner wall of said heatpipe.

13. A heatpipe as claimed in claim 5 wherein an outer wall of said heatpipe defines a positional marker to indicate an uppermost end of said small diameter gas conducting tube.

* * * * *